US006491557B2

(12) United States Patent
Tamaki

(10) Patent No.: US 6,491,557 B2
(45) Date of Patent: Dec. 10, 2002

(54) EXHAUST SYSTEM FOR WATERCRAFT

(75) Inventor: Masaru Tamaki, Iwata (JP)

(73) Assignee: Yamaha Hatsudoki Kabushiki Kaisha, Shjizuoka (JP)

( * ) Notice: Subject to any disclaimer, the term of this patent is extended or adjusted under 35 U.S.C. 154(b) by 0 days.

(21) Appl. No.: 09/990,217

(22) Filed: Nov. 21, 2001

(65) Prior Publication Data

US 2002/0061689 A1 May 23, 2002

(30) Foreign Application Priority Data

Nov. 21, 2000 (JP) ..... 2000-353961

(51) Int. Cl.[7] ..... B63H 21/32
(52) U.S. Cl. ..... 440/89
(58) Field of Search ..... 440/89, 38; 181/212, 181/235, 239, 259, 260; 114/55.5

(56) References Cited

U.S. PATENT DOCUMENTS 5,151,057 A 9/1992 Kobayashi et al.
5,176,547 A 1/1993 Kobayashi et al.
5,184,966 A 2/1993 Kobayashi et al.
5,209,683 A 5/1993 Imaeda et al.
5,446,250 A 8/1995 Oka
5,676,575 A * 10/1997 Fukuda et al. ..... 440/89
6,120,335 A 9/2000 Nakase et al.
6,261,140 B1 7/2001 Yoshida et al.

* cited by examiner

*Primary Examiner*—Ed Swinehart
(74) *Attorney, Agent, or Firm*—Knobbe, Martens Olson & Bear LLP

(57) ABSTRACT

A small watercraft comprises a hull having a longitudinal axis and an engine disposed within the hull. A tunnel is defined on an underside of the hull. A propulsion is driven by the engine and includes a jet pump unit disposed at least partially within the tunnel. An exhaust system communicates with the engine and extends to and terminates at an exhaust discharge outlet to discharge exhaust gases generated by the engine. The exhaust discharge outlet is located along the tunnel such that the exhaust gases are discharged into a space defined between the tunnel and the jet pump unit. An exhaust opening is located downstream of the exhaust discharge outlet and is defined between the tunnel and the jet pump unit. A barrier is located in the exhaust opening so as to form an exhaust sub-chamber in the tunnel upstream of the barrier.

18 Claims, 5 Drawing Sheets

EXHAUST SYSTEM FOR WATERCRAFT

RELATED APPLICATIONS

This application claims priority to Japanese Application No. 2000-353961, filed Nov. 21, 2000, the entire disclosure of which is hereby incorporated by reference herein.

BACKGROUND OF THE INVENTION

1. Field of the Invention

The present invention relates to a personal watercraft. More particularly, the present invention relates to an improved exhaust system for a personal watercraft.

2. Description of the Related Art

Personal watercraft have become very popular in recent years. This type of watercraft is sporting in nature and typically is configured to carry a rider and possibly one to three passengers. A relatively small hull of the personal watercraft commonly defines a riders' area and an engine compartment, which lies below the riders' area. An internal combustion engine frequently powers a jet propulsion unit, which propels the watercraft. The engine lies within the engine compartment in front of a tunnel formed on the underside of the watercraft hull. The jet propulsion unit is located within the tunnel and is driven by a drive shaft. The drive shaft usually extends between the engine and the jet propulsion device, through a wall of the hull tunnel.

Recently, the use of personal watercraft has been restricted on some bodies of water. Some proponents of the restrictions cite operation noise. Primarily because of the small size of personal watercraft, a relatively simple exhaust system generally is used, which does not provide a significant degree of silencing. In addition, because the small personal watercraft can be used on quite small bodies of water, the perceived noise levels may be greater than larger watercraft having unmuffled exhaust systems but which do not operate on these small bodies of water.

An exhaust system of a typical personal watercraft discharges engine exhaust to the atmosphere either through or close to the body of water in which the watercraft is operating. In one arrangement, the exhaust is discharged through a discharge opening formed in a rearwardly opening pump chamber, which surrounds the jet propulsion unit and a rear portion of the tunnel. The exhaust passes from the opening to the body of water along side the jet propulsion unit. Although this discharge arrangement successfully reduces exhaust noise under some conditions, there are problems associated with this arrangement. For example, as the watercraft turns, water from the jet propulsion unit can be directed into the space between the pump chamber and the tunnel. This water can lead to choking in the exhaust system, which can adversely affect engine performance. In addition, when the watercraft is accelerated to planing speeds, the discharge opening can be exposed to atmosphere. This typically results in an increase in noise pollution.

SUMMARY OF THE INVENTION

A need therefore exists for an improved exhaust system for a personal watercraft, which reduces noise pollution from the watercraft without adversely effecting engine performance.

Therefore, one aspect of the present invention involves a small watercraft that comprises a hull having a longitudinal axis and an engine disposed within the hull. A tunnel is defined on an underside of the hull. A propulsion is driven by the engine and includes a jet pump unit disposed at least partially within the tunnel. An exhaust system communicates with the engine and extends to and terminates at an exhaust discharge outlet to discharge exhaust gases generated by the engine. The exhaust discharge outlet is located along the tunnel such that the exhaust gases are discharged into a space defined between the tunnel and the jet pump unit. An exhaust opening is located downstream of the exhaust discharge outlet and is defined between the tunnel and the jet pump unit. A barrier is located in the exhaust opening so as to form an exhaust sub-chamber in the tunnel upstream of the barrier.

Another aspect of the present invention involves a small watercraft that comprises a hull having a longitudinal axis and an internal combustion engine disposed within the hull. A tunnel is defined on an underside of the hull. A propulsion device is driven by the engine and includes a jet pump unit disposed at least partially within the tunnel. An exhaust system communicates with the engine and extends to and terminates at an exhaust discharge outlet to discharge exhaust gases generated by the engine. The exhaust discharge outlet is located on the tunnel such that the exhaust gases are discharged into a space defined between the tunnel and the jet pump unit. The watercraft further including means for forming an exhaust sub-chamber within the space to reduce exhaust gas noise.

Yet another aspect of the present invention involves a small watercraft that comprises a hull. A recess is formed in a lower surface of the hull. A propulsion unit is mounted within the recess. An engine drives the propulsion unit. An exhaust system extends between the engine and the recess. The recess extends rearward to an outlet. A barrier is disposed around a portion of the propulsion unit at a location in the recess that is upstream of the outlet.

It should also be noted that all of these aspects are intended to be within the scope of the invention herein disclosed. These and other aspects of the present invention will become readily apparent to those skilled in the art from the following detailed description of two preferred embodiments with reference to the attached figures, the invention not being limited to the particular preferred embodiments disclosed.

BRIEF DESCRIPTION OF THE DRAWINGS

The above-mentioned and other features of the invention will now be described with reference to the drawings of two preferred embodiments of the present watercraft. The illustrated embodiment of the watercraft are intended to illustrate, but not to limit the invention. The drawings contain the following figures.

DETAILED DESCRIPTION OF THE PREFERRED EMBODIMENT

Figure 1:
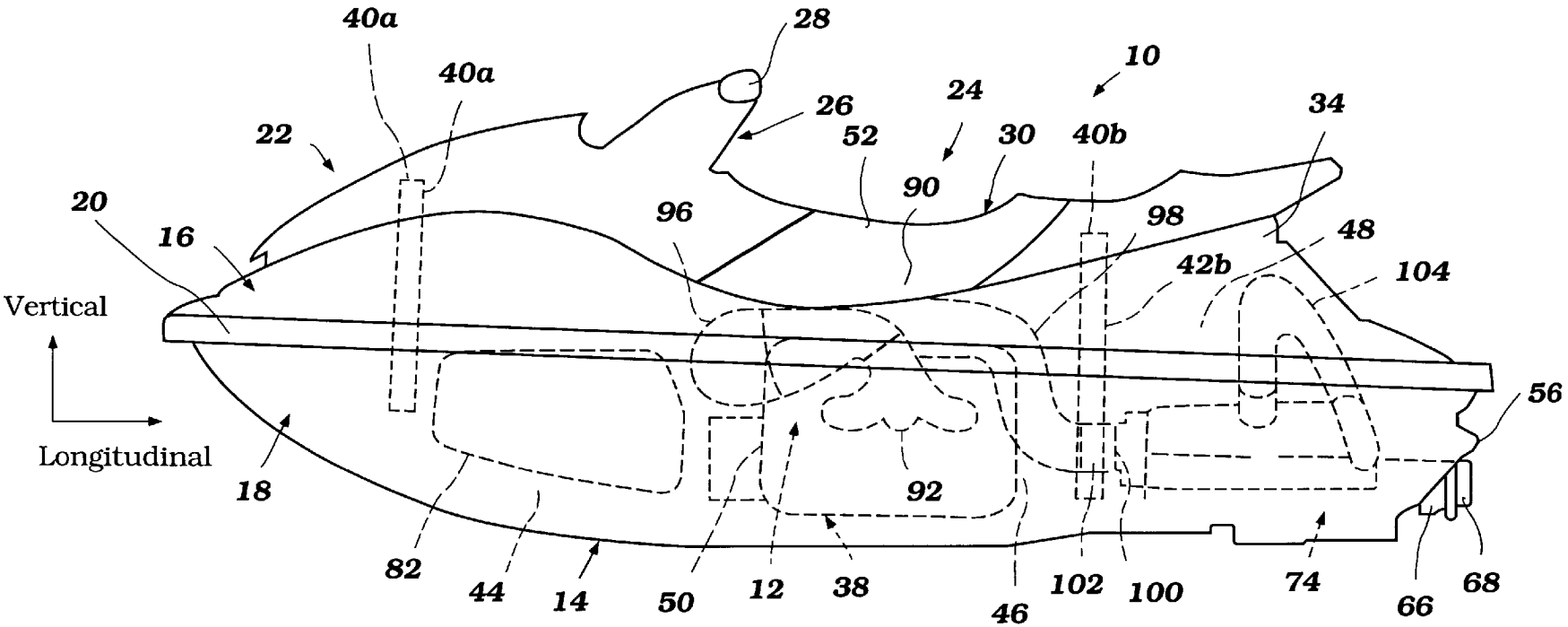
FIG. 1 is a partial sectional side view of a personal watercraft hull constructed in accordance with certain features and advantages of the present invention.

FIG. 1 illustrates personal watercraft 10 with an exhaust system 12 having certain features and advantages according to the present invention. The exhaust system 12 has particular utility when utilized with a personal watercraft. As such, the following description will focus on this form and will describe two preferred embodiments thereof. Various aspects and features of the watercraft and exhaust system, however, may have utility in a variety of other small watercraft, such as, for example, speedboats, jet boats, runabouts and the like.

Figure 2:
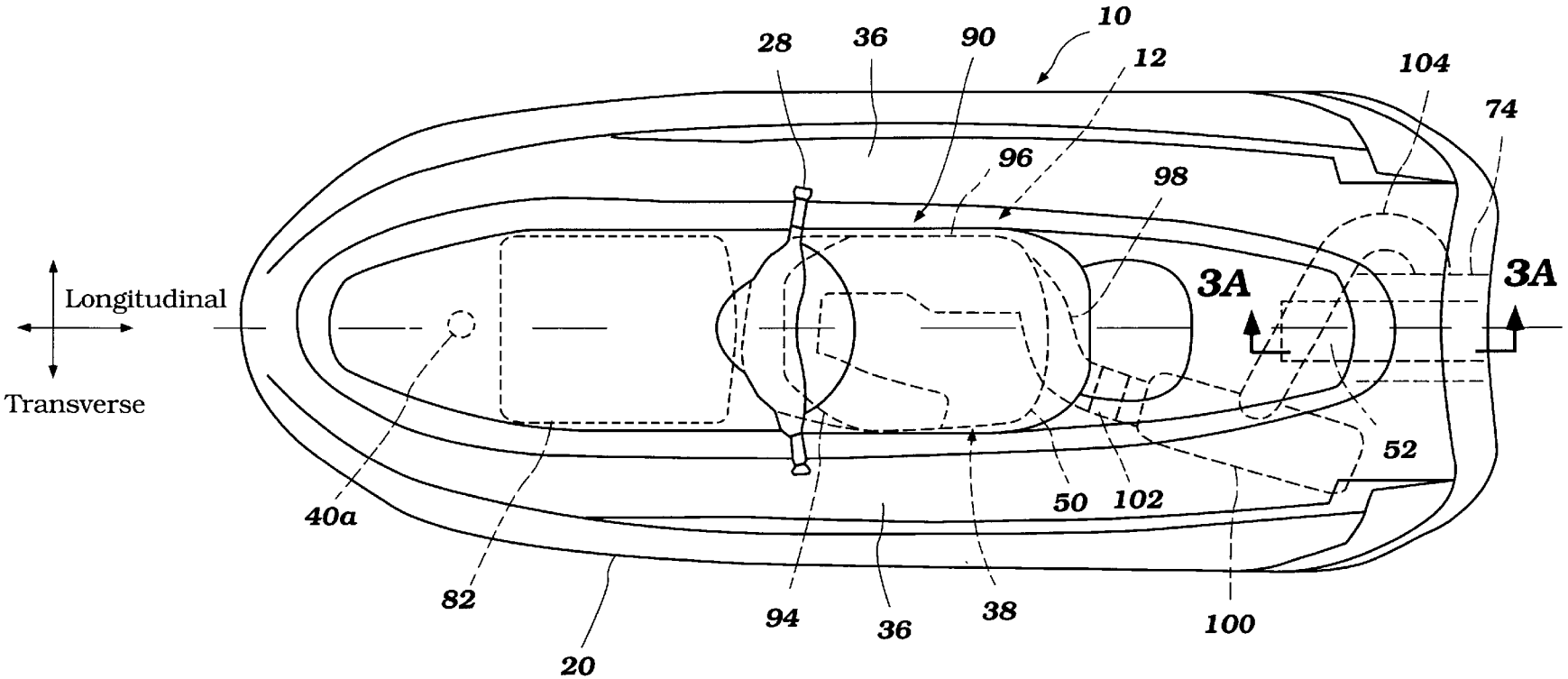
FIG. 2 is a top elevational view of the watercraft of FIG. 1.

As illustrated in FIGS. 1 and 2, the personal watercraft 10 will be described with reference to a coordinate system. The coordinate system includes a longitudinal axis that extends from the bow to the stem of the personal watercraft 10. A transverse axis lies perpendicular to the longitudinal axis and extends form the port side to the starboard side of the personal watercraft 10. Both the longitudinal axis and the transverse axis lie generally parallel to a surface of a body of water in which the watercraft is to be operated. The coordinate system also includes a vertical axis that lies normal to both the longitudinal and transverse axes (i.e., normal to the water surface).

As seen in FIG. 1, the personal watercraft 10 includes a hull, which is indicated generally by reference numeral 14. The hull 14 can be made of any suitable material; however, a presently preferred construction utilizes molded fiberglass, reinforced resin and/or a sheet molding compound. Additionally, various components of the hull 14 can be formed by a suitable lightweight material, such as plastic, especially those components on the upper side of the hull 14.

The hull is generally divided into an upper deck section 16 and a lower hull 18. A bond flange 20 connects the lower hull 18 to the upper deck section 16. The bond flange 20 is formed by cooperating flange sections that depend downward and extend about the outer periphery of the upper deck section 16 and the lower hull 18. These flange sections preferably are connected together by a suitable marine adhesive and by rivets. Of course, any other suitable means can be used to interconnect the lower hull 18 and the upper deck section 16. Additionally, the lower hull 18 and the upper deck section 16 can be integrally formed. A plastic trim preferably extends around the periphery of the bonding flange 20 to form a bumper.

As viewed in the direction from the bow to the stem of the watercraft, the upper deck section 16 includes a bow portion 22 and a rider's area 24. The bow portion 22 includes a steering column 26 that supports a handlebar assembly 28. In the illustrated embodiment, the steering column 26 extends away from the rider's area 24 in a manner that is similar to a racing motorcycle. This arrangement allows the operator to lean forward when grasping the handlebars. In this arrangement, the operator's feet are preferably placed significantly behind the knees, which hug the sides of the rider's area 24. This arrangement of the steering column 26 is preferred in part because it allows the operator to lean the watercraft lower into turns as will be explained in more detail below. However, it should be appreciated that the personal watercraft 10 may employ a more conventional steering column (i.e., one that extends towards the rider's area 24) and yet still achieve many of the advantages and benefits of the present invention.

The handlebar assembly 28, which extends from the steering column 26, controls the steering of the watercraft 10 in a conventional manner. The handlebar assembly 28 and/or the control mast 26 also carry a variety of controls of the watercraft 10, such as, for example, but without limitation, various gauges and/or displays, a throttle control, a start switch and a lanyard switch.

The rider's area 24 lies behind the control mast 26 and includes a seat assembly 30. In the illustrated embodiment, the seat assembly 30 has a longitudinally extending straddle-type seat which preferably may be straddled by an operator and by at least one passenger. In a preferred form, the seat has a sufficient length to support two people. The seat assembly 30, at least in principal part, is formed by a seat cushion 32 supported on a raised pedestal 34. The raised pedestal 34 forms a portion of the upper deck section 16, and has an elongated shape that extends longitudinally along the center of the watercraft 10 from the control mast 26 toward the aft end of the watercraft 10. The seat cushion 32 desirably is removably attached to a top surface of the raised pedestal 34 by one or more latching mechanisms (not shown) and covers the upper surface of the pedestal 34 for rider and passenger comfort. In some modes, the seat cushion 32 can be formed in several pieces, each individually attached to and removed from the seat pedestal 34. In this manner, select sections of the seat cushion 32 can be removed without removing the entire seat cushion 32.

The upper deck 16 advantageously includes a pair of longitudinally extending surfaces 36 (FIG. 2) that are positioned on opposite sides of the aft end of the upper deck section 16. The surfaces 36 define a pair of foot areas that extend generally parallel to the sides of the pedestal 34. In this position, the operator and any passengers sitting on the seat assembly 30 can place their feet on the foot areas during normal operation of the personal watercraft 10. A non-slip (e.g., rubber) mat desirably covers the foot areas to provide increased grip and traction for the operator and passengers.

An access opening (not shown) is preferably located in the upper surface of the upper deck 16. The access opening desirably opens into a hull interior 38 formed within the hull 16. At least a portion of the seat cushion 32 covers and seals the access opening. If desired, a seal (not shown), such as a rubber gasket, can be used to ensure the access opening is closed in a watertight manner. When the seat cushion 32 is removed, the interior hull 38 is accessible through the access opening. A cargo holder or box may be positioned beneath the seat cushion 32 with the access opening, substantially within the hull interior 38 bounded by the raised pedestal 34.

The hull 14 preferably includes a ventilation system that has one or more air inlets that communicate with air ducts to allow atmospheric air to enter and exit the hull interior 38. In the illustrated arrangement, a first air inlet 40*a* is formed in the bow portion 22 of the upper deck 16 and communicates with an first air duct 42*a* that opens into the hull interior 38 at a point below the bow portion 22. A second air inlet 42*b* is formed in the rider's area 24 of the upper deck 16 and communicates with an second air duct 42*a* that opens into the hull interior 38 at a point below the rider's area 24. The air intakes 40*a*, 40*b* and ducts 42*a*, 42*b* provide a source of fresh air for cooling and also for combustion when an internal combustion engine is used to power the watercraft 10. Except for the ventilation system, the hull interior 38 is normally substantially sealed so as to enclose the interior components of the watercraft 10 from the body of water in which the watercraft 10 is operated.

The hull 14 may include forward and rear bulkheads (not shown), which can be used to reinforce the lower hull 18 internally. However, the hull can be constructed without one or both of the bulkheads and additional bulkheads also can be used. The bulkheads can be used to define, in part, a fuel compartment 44, the engine compartment 46, and the propulsion compartment 48. Each bulkhead preferably is secured to the lower section of the lower hull 18 by a suitable marine adhesive, and more preferably is secured to the hull along the lengths of its sides and bottom edges. The upper edge of the forward bulkhead also can be adhered to the upper deck section. In addition or in the alternative, each bulkhead can be attached to the lower hull 18 in the manner described in U.S. Pat. No. 5,921,198, issued Jul. 13, 1999, to the same assignee of this application, the entire contents of which is hereby incorporated by reference.

The watercraft 10 includes a propulsion unit comprising a prime mover and a propulsion device. In the illustrated embodiment, the prime mover is an internal combustion engine 50 that will be described in detail below. However, it should be appreciated that the personal watercraft 10 can employ other types of prime movers, such as, for example, a gas turbine. Similarly, the propulsion device in the illustrated embodiment is a jet pump unit 52. However, it should be appreciated that the watercraft 10 can employ other types of propulsion devices such as, for example, a propeller.

Figure 3B:
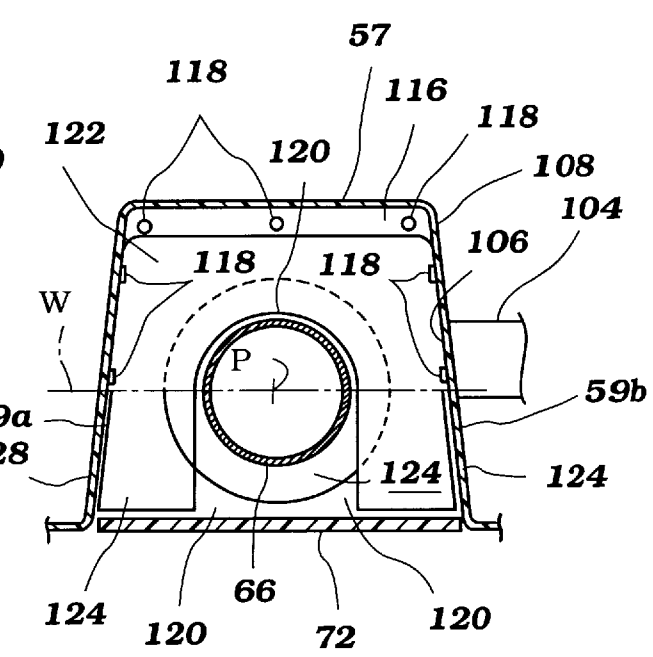
FIG. 3B is a cross-sectional view taken along line 3B—3B of FIG. 3A.
Figure 3A:
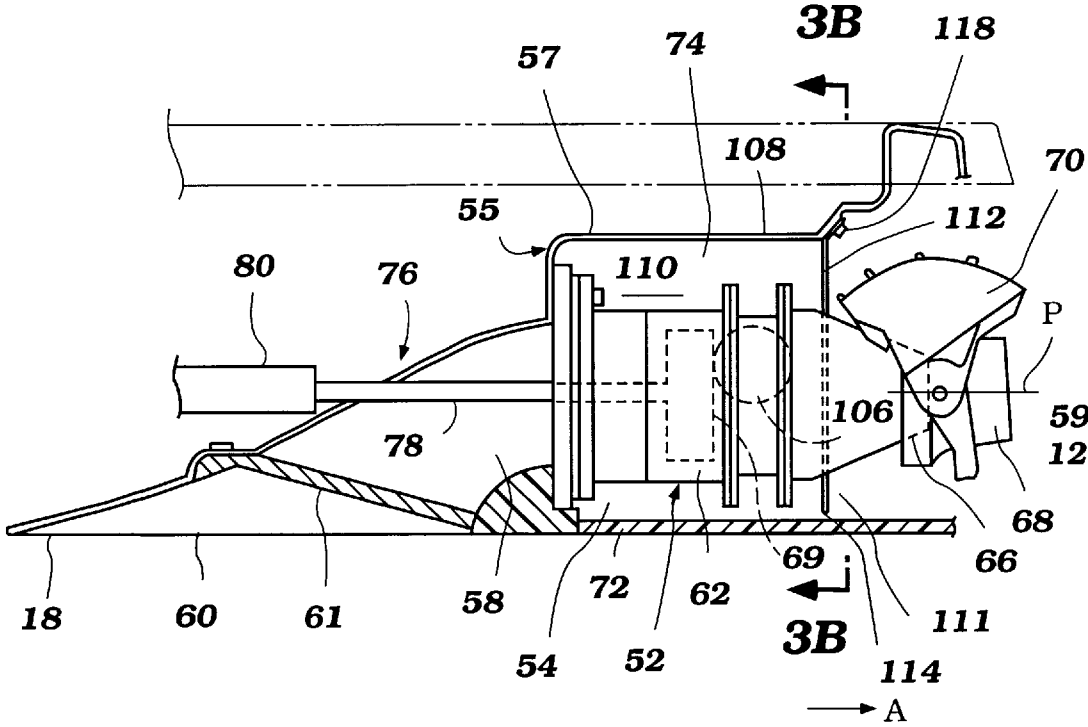
FIG. 3A is a cross-sectional view of a pump chamber taken along line 3A—3A of FIG. 2.

With particular reference to the embodiment illustrated in FIGS. 1 and 3A, the jet pump unit 52 is mounted within a tunnel 54. The illustrated tunnel 54 is formed, in part, by a recessed portion 55 formed in the lower hull 18 that defines a upper wall 57 and a pair of side walls 59*a*, 59*b* of the tunnel 54 (see FIG. 3B). Other wall configurations also can be used (e.g., a semicircular wall). The tunnel 54 extends up into the lower hull 18 and opens through a transom 56 of the watercraft 10. An intake duct 58, which is disposed within or formed by a portion of the tunnel 54, extends between the jet pump unit 52 and an inlet opening 60. In the illustrated embodiment, the inlet opening 60 generally faces downward and is disposed on relative flat section of the lower hull 18. Preferably, the intake duct 58 includes a grate or screen 61 for blocking foreign objects as is well known in the art. The duct 58 leads to the jet pump unit 52 that includes an impeller housing 62 containing an impeller 64. The jet pump unit 52 also includes a discharge nozzle 66 located downstream of the impeller.

A steering nozzle 68 is supported at the downstream end of the discharge nozzle 66 by a pair of vertically extending pivot pins (not shown). In an exemplary embodiment, the steering nozzle 68 has an integral lever on one side that is coupled to the handlebar assembly 28 through, for example, a bowden-wire actuator, as is known in the art. In this manner, the operator of the watercraft 10 can move the steering nozzle 68 to effect directional changes of the watercraft 10. The steering nozzle 68 can also be supported by a gimble ring so that the steering nozzle can be trimmed. The orientation of the steering nozzle defines a propulsion axis. In addition, a reserve thrust bucket 70 can be positioned on the aft end of the jet pump unit 52 to provide reverse thrust for slowing the watercraft 10 and moving the watercraft 10 rearward.

A ride plate 72 covers a portion of the tunnel 54 behind the inlet opening 60 to enclose the jet pump unit 52 within the tunnel 54. In this manner, the lower opening of the tunnel 54 is closed such that the ride plate 72 forms at least a portion of a planing surface for the watercraft 10. A pump chamber 74 then is defined within the tunnel 54 covered by the ride plate 72.

An impeller shaft assembly 76 supports the impeller 64 within the impeller housing 62. The aft end of an impeller shaft 78 is suitably supported and journalled within a compression chamber defined within the impeller housing 62. The shaft 78 rotates about a generally longitudinally extending axis; however, this impeller axis can be skewed either upwards or downwards in some variations of the watercraft. The impeller shaft 78 extends in a forward direction through a front side of the tunnel 54 and through the bulkhead 132. A protective casing 80 preferably surrounds a portion of the impeller shaft 78 that lies forward of the intake duct 58; however, this casing 80 can be omitted when other conventional types of impeller shaft mounting arrangements are employed with the watercraft.

The impeller shaft 78 is coupled to an output shaft (not shown) of the engine 50. The engine 50 is mounted within the engine compartment 46 in any suitable manner. For instance, a set of resilient engine mounts (not shown) may be used to connect the engine 50 to a set of stringers (not shown) of the lower hull 18, to a molded insert piece (not shown) secured (e.g., adhered) to the lower hull 18, or directly to bosses formed onto the lower inner wall of the lower hull 18. Other engine mounting arrangements are also possible to securely support the engine 50 within the hull 14.

The engine 50 preferably is mounted to the lower hull 18 in a central position relative to both the width (in the transverse direction) and the length (in the longitudinal direction) of the watercraft 10. This position can be shifted of course to improve watercraft balance, handling, and performance. The engine 50 may be of various configurations and sizes and can operate on any of a variety of principles. For example, the engine 50 can be an internal combustion engine and can operate on a two-stroke, four-stroke or rotary combustion principle. Additionally, the engine 50 can comprise any number of cylinders arranged in a variety of orientations (e.g., inline, V-type, opposed). In the illustrated embodiment, the engine 50 is an inline, two-stroke engine having three cylinders; however, the illustrated engine type merely exemplifies one preferred form of the watercraft engine.

The engine 50 has an engine body defined by a cylinder head assembly, a cylinder body and a crankcase member. In the illustrated embodiment, the crankcase member is located near a bottom surface of the lower hull, the cylinder body is disposed above the crankcase member, and the cylinder head assembly is affixed onto of the cylinder body. A crankshaft is journaled within a crankcase formed between the cylinder body and the crankcase member and extends generally in a longitudinal direction. In the illustrated embodiment, the crankshaft functions as the engine output shaft. It is understood, however, that the engine can be oriented such that its crankshaft extends transversely or vertically.

A fuel supply system delivers fuel to the engine 50 in a known manner. The fuel supply system includes a fuel tank 82 positioned in the fuel compartment 44 located in front of the engine 50. Although not illustrated, at least one pump desirably delivers fuel from the fuel tank 82 to the engine 50 through one or more fuel lines.

A battery (not shown) stores power generated by the engine 50 as is also well known. The battery can be used to provide power to various watercraft components The battery can be used to start the engine 50 by providing power to, for example, a starter motor. Desirably, the battery is secured by a battery holder that is mounted to the lower hull 18 above the tunnel 54 in the propulsion compartment 48.

The engine 50 typically draws air from the engine compartment 46 through an engine air induction system (not shown). The induction system typically comprises an air intake device disposed on the upper portion of the engine 50, which passes air from the engine compartment 46 to an air intake manifold and carburetor, which supply a fuel/air charge to a plurality of engine cylinders in a known manner. Of course, other arrangements, such as direct or indirect fuel injection, can be used to provide a fuel charge to the engine 50.

Because the engine is conventional and well known to those skilled in the art, a further description of the internal workings of the engine is not believed necessary for an understanding of the present sporting watercraft design.

An engine exhaust system 90, which is best seen in FIGS. 1 and 2, typically comprises an exhaust manifold 92 that transfers exhaust gases exiting the combustion chambers of the engine through exhaust passages to a first exhaust pipe 94. The exhaust manifold thus generally comprises a merge chamber and a plurality of exhaust runner passages. The illustrated first exhaust pipe 94 extends forwardly from the manifold 92 and wraps around the front of the engine 50 to transfer the exhaust gases to an expansion chamber 96. The exhaust chamber 96 subsequently transfers these exhaust gases through a second exhaust pipe 98 to a watertrap 100. In the illustrated arrangement, the second exhaust pipe 98 is connected to the watertrap 100 via a flexible coupling 102. The watertrap 100 is a well known device that allows the passage of exhaust gases, but contains baffles (not shown) which inhibit water from passing back through the engine exhaust system 90 into the engine 50. In the present embodiment, the watertrap 100 is located behind the engine 50, slightly forward of the transom 56 of the watercraft 10 on the port side of the tunnel 54. The watertrap 10 transfers the exhaust gases to a third exhaust pipe 104, which discharges the exhaust gases to the atmosphere and/or to the water.

As best seen in FIGS. 2 and 3B, the third exhaust pipe 104 extends from an upper end of the watertrap 100 to an outlet opening 106, which opens into the tunnel 54 to communicate with pump chamber 74 between the walls 108 of the tunnel 54 and the propulsion unit 52. Preferably, the outlet opening 106 is located on the starboard side of the tunnel 54 such that the third exhaust pipe 104 extends upward over and across the tunnel 54. In addition, the outlet opening 106 lies at approximately the same elevation as the water displacement line of the watercraft 10 (see line "W" of FIG. 3B). The water displacement line is the water level when the watercraft 10 is at rest or operating at low speeds. Of course, the water displacement line can rise or fall depending upon the weight and number of riders. The exhaust gases flow from the pump chamber 74 to the body of water by passing around the propulsion unit 52, the discharge nozzle 66 and the reverse thrust bucket 70. An exhaust outlet 111 is therefore defined by the space between the tunnel 54 (i.e., the ride plate 72 and the recessed portion 55 of the lower hull 18) and the propulsion unit 52.

As mentioned above, when the watercraft 10 turns, water from the discharge nozzle 66 propulsion unit can be directed into exhaust outlet 11 and into the pump chamber 74. In a similar manner, the reverse thrust bucket 70 can direct water into exhaust outlet 111 and into the pump chamber 74. This water can block the outlet opening 106, which can cause choking in the exhaust system 12, adversely affecting engine performance. In addition, as the watercraft accelerates to planing speeds, the discharged opening 106 can be exposed to atmosphere. This typically results in an increase in noise levels.

As such, the exhaust system 12 preferably includes an exhaust sub-chamber 110, which is best seen in FIGS. 3A and 3B. In the illustrated embodiment, the exhaust sub-chamber 110 is defined within the pump chamber 74, which, as explained above, preferably lies within the tunnel 54 and generally surrounds jet pump unit 52. A barrier 112 partially closes the exhaust opening 111 to define, in part, the exhaust sub-chamber 110. Preferably, the exhaust opening 111 reduces the cross-sectional area of the exhaust opening 111 by at least 50%, and more preferably by at least 75% and most preferably by 90%. A gap 114 lies between the barrier 112 and the tunnel 54. The exhaust gases exit the sub-chamber 110 through the gap 114. The outlet opening 106 preferably communicates directly with the sub-chamber 110.

In the embodiment illustrated in FIGS. 3A and 3B, the barrier 112 comprises includes a flanged portion 116 along the upper edge and upper side edges of the barrier. In this manner, the barrier 112 can be attached to the recessed portion 57 of the lower hull 18 by a series of bolts 118 or adhesive. The barrier 112 defines an opening 120, which is preferably configured to fit around the discharge nozzle 66. The opening 120 defines a exhaust passage 121, which preferably located below the longitudinal axis P of the discharge nozzle 66. In this manner, the exhaust gases are preferably discharged below the discharge nozzle 66, which results in increased noise reduction.

As explained above, the flanged portion 116 secures an upper portion 122 of the barrier 112 to the hull 18. Preferably, a lower portion 124 of the barrier 112 is not secured to the tunnel 54 such that the lower portion 124 can deflect along the direction of arrow A in FIG. 3A. In one embodiment, the upper portion 122 is made of a first material and the lower portion 124 is made of a second material that is more resilient than the first material. For example, in one arrangement, the upper portion 122 can be made of a less resilient material, such as, for example, metal, plastic or a hard rubber while the lower portion 124 is made of a more resilient material, such as, for example, rubber. In another embodiment, the entire barrier 112 can be made of a resilient material, such as, for example, rubber. In the yet another embodiment, the barrier 112 can be made of a fairly stiff material (e.g., a metal) and thus the barrier 112 tends to deflect only in the lower portion 124, which is not secured to the hull 18. All of these arrangements preferably allow the barrier 112 to flex and move in response to pressure changes in the exhaust gases. This movement dissipates the energy in the pressure waves generated by the exhaust gases thereby reducing the noise of the exhaust system 12.

Figure 4B:
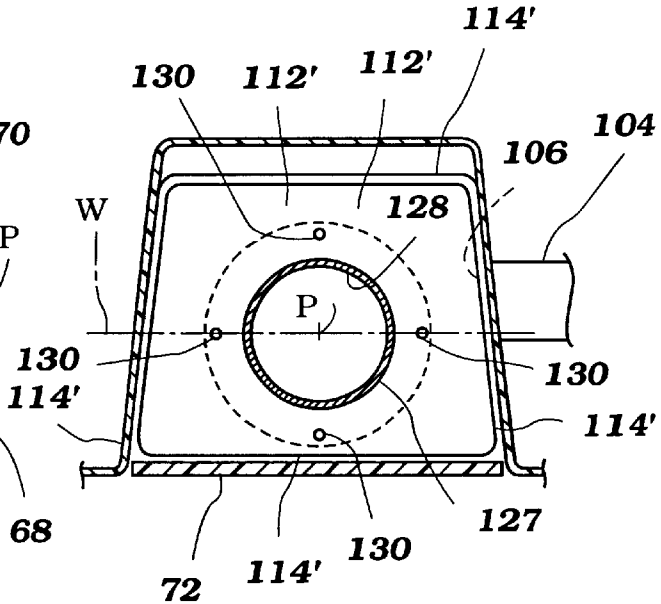
FIG. 4B is a cross-sectional view taken along line 4B—4B of FIG. 4A.
Figure 4A:
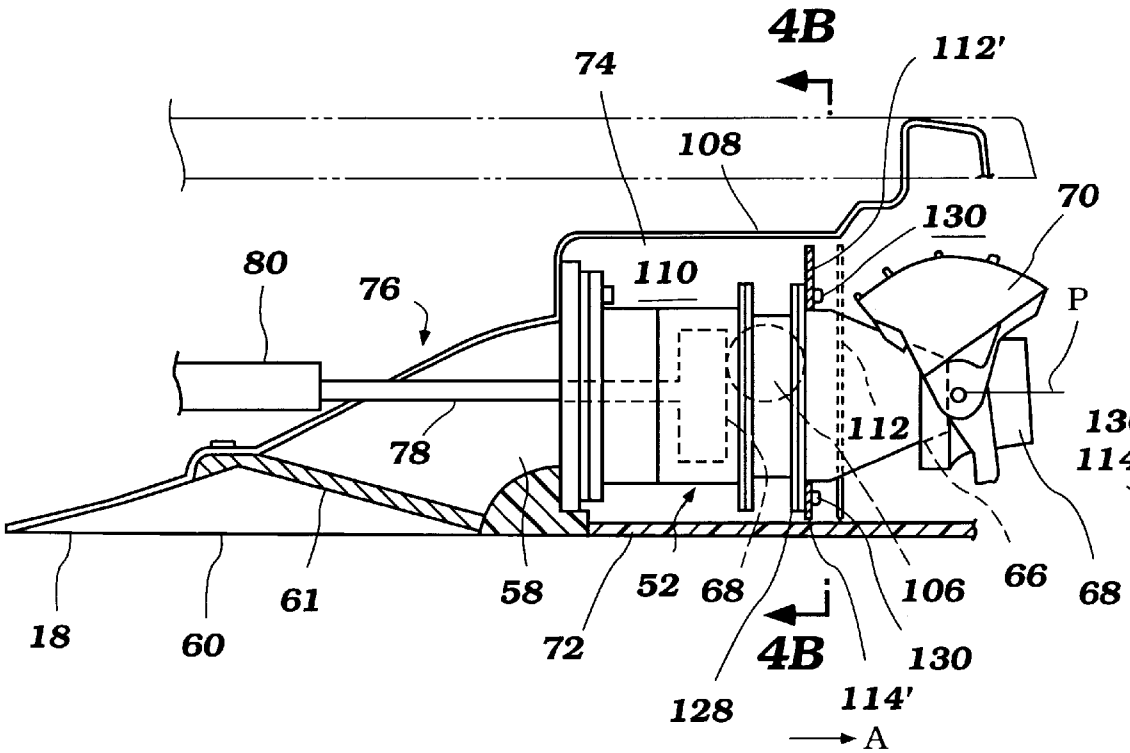
FIG. 4A is a cross-sectional view of another pump chamber arranged and configured in accordance with certain features, aspects and advantages of the present invention.

FIGS. 4A and 4B illustrate a modified embodiment of the barrier 112' and the exhaust sub-chamber 110'. In this embodiment, the barrier 112' includes an inner portion 127 that is attached to an annular flange 128 provided on the propulsion unit 52. Bolts 130 or an adhesive can used to attach the inner portions of the barrier 112 to the flange. In this arrangement, the gap 114', which lies between the barrier 112' and the tunnel 54, extends around the periphery of the barrier 112'. The outer periphery of the barrier 112' is not secured to the tunnel 54 and thus can flex in the direction of arrow A. In one embodiment, the outer periphery of the barrier 112' can be made of a more resilient material (e.g., rubber) as compared to the material (e.g., metal, plastic, or hard rubber) of the inner portions. In another embodiment, the entire barrier can be made of a resilient material (e.g. rubber).

In a modified embodiment, the barrier 112" can be positioned around the discharge nozzle 66 as indicated by the dashed lines of FIG. 4A. Such an arrangement advantageously increases the size of the sub-chamber 110, which generally increases the noise reduction resulting from use of the sub-chamber 110.

Figure 5:
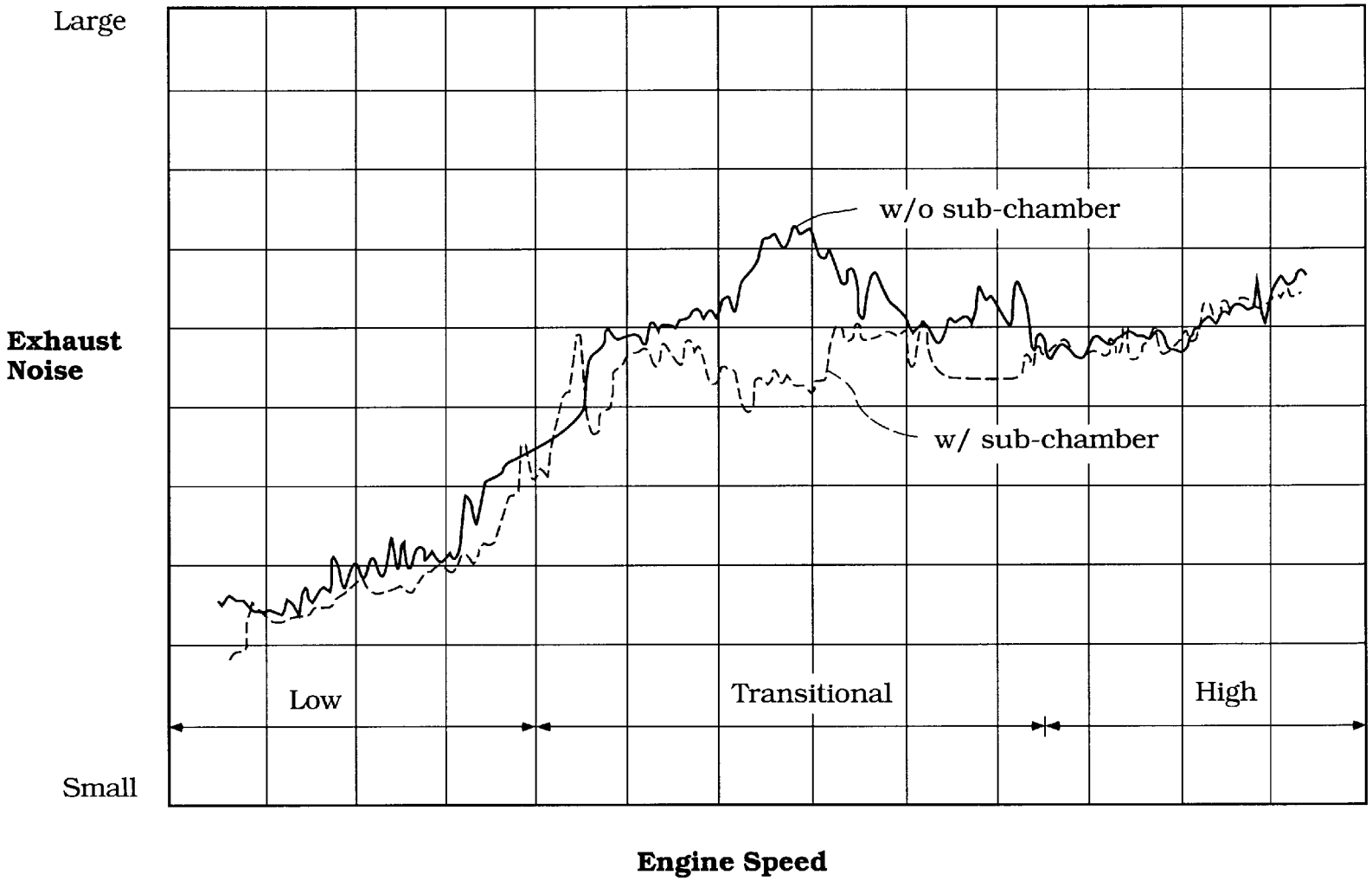
FIG. 5 is a graph of experimental data showing a relationship between noise and engine speed.

FIG. 5 illustrates an experimentally derived relationship between engine speed and noise level. The dashed line indicates the noise level when the sub-chamber 110 is provided in the exhaust system 12 while the solid line indicates when the barrier 112 is removed from the exhaust system 12. As illustrated in FIG. 5, when the watercraft is at low engine speeds (e.g., when trolling), the lower part of the hull 18 is generally submerged. The noise levels are generally low because the exhaust is discharged to the body of water. When the watercraft 10 is planing, the engine speeds are generally high and a lower portion of the hull 18 generally lies close to parallel with the water level. During the transition between low engine speeds and high engine speeds (approximately 3800–4800 RPM), the engine noise increases dramatically. This is in part due to the increased angle between the hull and the water level. As shown in FIG. 5, the addition of the sub-chamber 110 to the exhaust system 12 dramatically reduces the noise level during this transition state.

Although this invention has been described in terms of certain embodiments, other embodiments apparent to those of ordinary skill in the art also are within the scope of this invention. Thus, various changes, modifications, combinations and sub-combinations may be made without departing from the spirit and scope of the invention. For example, the present invention could be used in conjunction with a watercraft such as a jet boat or the like. Accordingly, the scope of the invention is intended to be defined only by the claims that follow.

What is claimed is:

1. A small watercraft comprising a hull having a longitudinal axis, an internal combustion engine disposed within the hull, a tunnel defined on an underside of the hull, a propulsion device being driven by the engine and including a jet pump unit disposed at least partially within the tunnel, an exhaust system communicating with the engine and extending to and terminating at an exhaust discharge outlet to discharge exhaust gases generated by the engine, the exhaust discharge outlet being located along the tunnel such that the exhaust gases are discharged into a space defined between the tunnel and the jet pump unit, an opening located downstream of the exhaust discharge outlet and defined between the tunnel and the jet pump unit, a barrier located in the opening so as to form an exhaust sub-chamber in the tunnel upstream of the barrier, the barrier comprising a first portion and a second portion, the first portion being attached to the tunnel, the second portion being allowed to flex along the longitudinal axis, and an exhaust opening that is formed, at least in part, by a gap defined between the second portion of the barrier and the tunnel while an interface between the first portion and the tunnel is substantially sealed.

2. A small watercraft as in claim 1, wherein the first portion is attached to an upper portion of the tunnel and the gap is formed, at least in part, between the second portion and a lower portion of the tunnel.

3. A small watercraft as in claim 2, wherein the barrier is made of rubber.

4. A small watercraft as in claim 2, wherein the majority of the gap is disposed below a longitudinal axis of a discharge nozzle of the propulsion unit.

5. A small watercraft as in claim 2, wherein the upper portion is made of a first material and the lower portion is a made of a second material, said second material being more resilient that the first material.

6. A small watercraft as in claim 5, wherein the second material is rubber.

7. A small watercraft as in claim 1, wherein the first portion is made of a first material and the second portion is a made of a second material, said second material being more resilient that the first material.

8. A small watercraft as in claim 8, wherein the second material is rubber.

9. A small watercraft as in claim 1, wherein the barrier blocks at least 50% of the exhaust opening.

10. A small watercraft as in claim 1, wherein the barrier blocks at least 75% of the exhaust opening.

11. A small watercraft as in claim 1, wherein the barrier blocks at least 90% of the exhaust opening.

12. A small watercraft comprising a hull having a longitudinal axis, an internal combustion engine disposed within the hull, a tunnel defined on an underside of the hull, a propulsion device being driven by the engine and including a jet pump unit disposed at least partially within the tunnel, an exhaust system communicating with the engine and extending to and terminating at an exhaust discharge outlet to discharge exhaust gases generated by the engine, the exhaust discharge outlet being located along the tunnel such that the exhaust gases are discharged into a space defined between the tunnel and the jet pump unit, an opening located downstream of the exhaust discharge outlet and defined between the tunnel and the jet pump unit, a barrier located in the opening so as to form an exhaust sub-chamber in the tunnel upstream of the barrier, the barrier comprising an inner portion which is attached to the jet pump unit and an outer periphery portion which is allowed to flex along the longitudinal axis, and an exhaust opening that is formed, at least in part, by a gap defined between the outer periphery portion and the tunnel while an interface between the inner portion and the jet pump unit is substantially sealed.

13. A small watercraft as in claim 12, wherein the barrier is made of rubber.

14. A small watercraft as in claim 12, the inner portion is made of a first material and the outer periphery portion is a made of a second material, said second material being more resilient that the first material.

15. A small watercraft as in claim 14, wherein the second material is rubber.

16. A small watercraft as in claim 12, wherein the barrier blocks at least 50% of the exhaust opening.

17. A small watercraft as in claim 12, wherein the barrier blocks at least 75% of the exhaust opening.

18. A small watercraft as in claim 12, wherein the barrier blocks at least 90% of the exhaust opening.

* * * * *